United States Patent [19]

Fetouh et al.

[11] Patent Number: 4,753,045

[45] Date of Patent: Jun. 28, 1988

[54] ADJUSTABLE DOUBLE END GRINDING MACHINE

[75] Inventors: Mohamed A. Fetouh; Antoni J. Malarz, both of Troy, Mich.

[73] Assignee: General Motors Corporation, Detroit, Mich.

[21] Appl. No.: 840,439

[22] Filed: Mar. 17, 1986

Related U.S. Application Data

[63] Continuation-in-part of Ser. No. 782,435, Oct. 1, 1985, abandoned.

[51] Int. Cl.[4] ..... B24B 7/17

[52] U.S. Cl. ..... 51/112; 51/134

[58] Field of Search ..... 51/113, 114, 112, 11 R, 51/132, 118, 134

[56] References Cited

U.S. PATENT DOCUMENTS

| | | | |
|---|---|---|---|
| 1,795,654 | 3/1931 | Luebben | 51/114 |
| 1,906,731 | 5/1933 | Wuerfel | 51/112 |
| 1,931,810 | 10/1933 | Behle | 51/114 |
| 1,965,020 | 7/1934 | Young | 51/118 |
| 1,992,452 | 2/1935 | Troendly | 51/118 |
| 2,636,322 | 4/1953 | Carlson et al. | 51/112 |
| 2,931,144 | 4/1960 | Price et al. | 51/118 |
| 3,142,137 | 7/1964 | Fallon et al. | 51/111 |
| 3,382,622 | 5/1968 | Dunn | 51/115 |
| 3,393,473 | 7/1968 | Rimmer | 51/112 |
| 3,458,957 | 8/1969 | Dunn et al. | 51/118 |
| 3,469,351 | 9/1969 | Thielenhaus | 51/118 |

FOREIGN PATENT DOCUMENTS

| | | | |
|---|---|---|---|
| 0576105 | 5/1933 | Fed. Rep. of Germany | 51/114 |

*Primary Examiner*—Frederick R. Schmidt
*Assistant Examiner*—Robert A. Rose
*Attorney, Agent, or Firm*—Robert J. Outland

[57] ABSTRACT

Arrangements of four-axis adjustable connecting rod grinding machines are disclosed having four separately driven and adjustable grinding wheels carried in opposed pairs on opposite sides of a moving work support to grind simultaneously the opposite sides of both ends of a connecting rod or the like with sequential feeding of plural workpieces. Adjustable means supporting the grinding wheel pairs provide flexibility for setting up to process connecting rods of differing lengths in sequential batches or runs.

11 Claims, 6 Drawing Sheets

ADJUSTABLE DOUBLE END GRINDING MACHINE

CROSS-REFERENCE TO RELATED APPLICATION

This application is a continuation-in-part of U.S. patent application Ser. No. 782,435 filed Oct. 1, 1985 and now abandoned.

FIELD

This invention relates to grinding machines and more particularly to adjustable four-axis grinding machines for simultaneously grinding the opposite faces of both ends of small articles, such as engine connecting rods.

BACKGROUND

At present, two different types of grinding machines are in common use for grinding the opposite faces of small parts such as engine connecting rods and the like. In the case of planar, or flat, connecting rods in which the faces of the opposite ends lie in common parallel planes, the faces may be ground on a double disc grinder in which a rotary feed wheel passes between two grinding wheels carrying the connecting rods to be ground so that the faces of both ends are ground in common planes at the same time. In the case of stepped connecting rods, which have different dimensions between the faces of the opposite ends, use of a double disc grinder is not practical. However, such stepped connecting rods may be ground on a multiple vertical spindle center column grinder in which only one side of the rod is ground at a time, separate wheels being provided for grinding the faces of the stepped opposite ends.

Thus, a double disc grinding machine works well on flat sided, or planar, rods but cannot be used in its present form for stepped rods. On the other hand, a center column grinder can be used to finish either stepped or flat sided rods but, in both cases, requires that the sides be finished separately and that the part be turned over between these finishing steps.

INVENTION SUMMARY

The present invention provides new grinding machines which are capable of finishing four parallel surfaces on opposite sides of opposite ends of connecting rods and other similar articles, all during a single grinding step. A feature of the machines is that they provide four individual grinding wheels arranged in two opposing pairs, the wheels of which are laterally spaced to grind both faces of the opposite ends of connecting rods or the like. The opposing wheels are arranged on separate axes, preferably aligned or intersecting. Another feature is that the grinding wheels are individually adjustable toward and away from the workpieces to provide for finishing all forms of flat or stepped surface configurations. Another feature is that the dual opposed grinding wheels are carried on separate means which are laterally adjustable to accommodate connecting rods and other workpieces of different lengths. An additional feature is that alternative reciprocating or continuous feed means may be provided for transporting a plurality of workpieces to be ground past the grinding wheel surfaces.

Thus the machines of the present invention are adjustable to provide flexibility for conversion to grind various sizes and styles of connecting rods or other articles to be ground and can be easily adjusted to provide for the machining of differing styles of parts in individual batches of like parts.

These and other features and advantages of the invention will be more fully understood from the following description of selected embodiments taken together with the accompanying drawings.

DRAWINGS

DESCRIPTION

Figure 1:
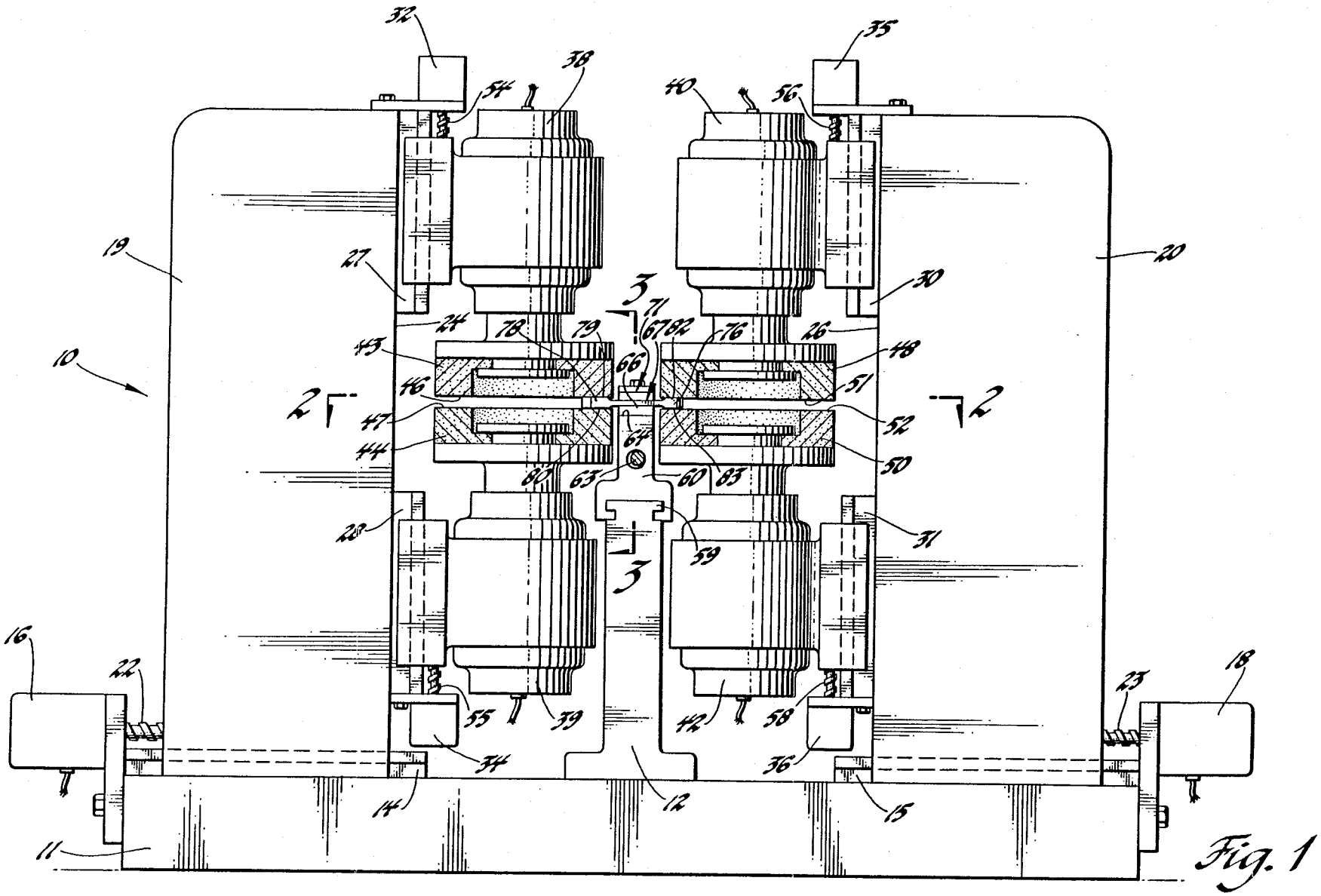
FIG. 1 is a side elevational view partially in section, of a four-axis flexible grinding machine formed in accordance with the invention.
Figure 2:
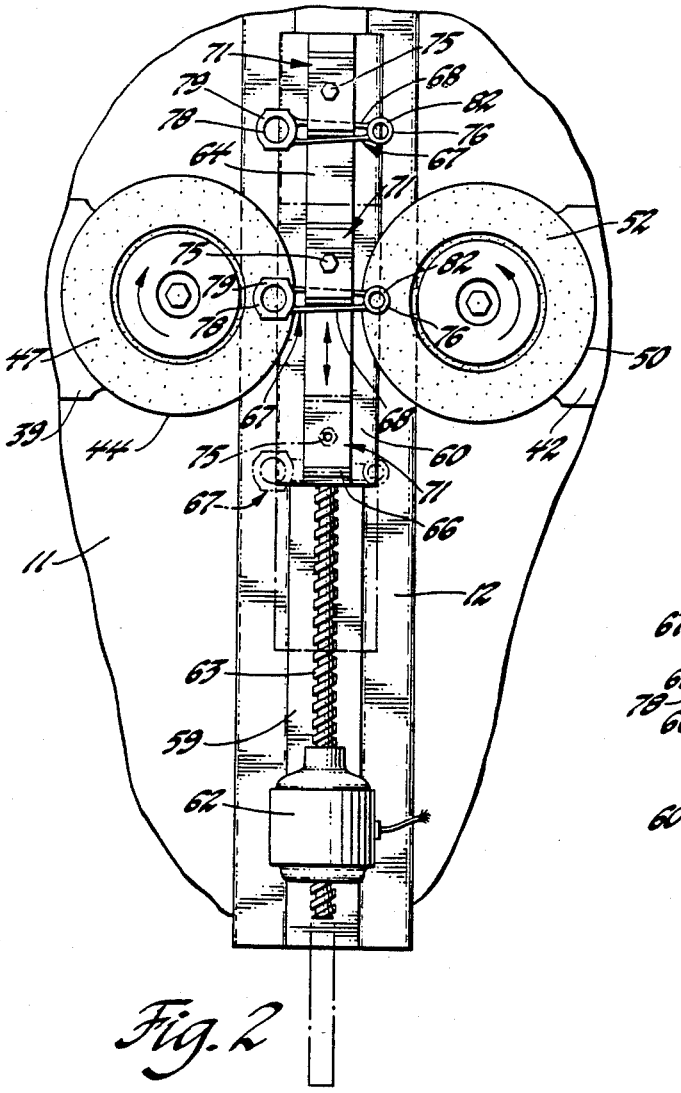
FIG. 2 is a fragmentary cross-sectional view downward from the plane indicated by the line 2—2 of FIG. 1 and illustrating the grinding and reciprocating transversing mechanisms of the machine.
Figure 3:
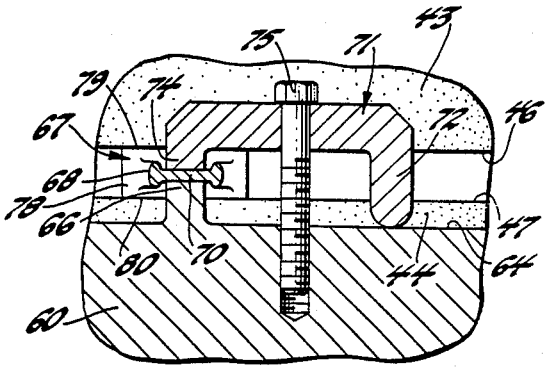
FIG. 3 is a fragmentary transverse cross-sectional view from the plane indicated by the line 3—3 of FIG. 1 showing a connecting rod clamping device.

In FIGS. 1-3 of the drawings, numeral 10 generally indicates an adjustable four-axis grinding machine, or grinder, formed in accordance with the invention. Machine 10 includes a base 11 on which are mounted a central table support 12, a pair of longitudinally extending guide ways 14, 15 on either side of the support 12 and a pair of longitudinal traversing motors 16, 18 at the ends of the base and the guide ways. The base also supports a pair of vertically upstanding pedestals 19, 20, which engage the guide ways 14, 15, respectively, and are longitudinally movable therealong by the action of traversing screws 22, 23, driven by the motors 16, 18, respectively.

On their inner sides 24, 26, facing one another and the table support 12, the pedestals 19, 20, respectively, carry vertically spaced and aligned pairs of guide ways 27, 28 and 30, 31 with vertical traversing motors 32, 34, 35, 36 being mounted at their ends. Motors 32, and 35 are above the upper guide ways 27, 30, respectively, and motors 34, 36 are underneath the lower guide ways 28, 31, respectively.

Four separate grinding wheel drive motors 38, 39, 40, 42 are provided, mounted for vertical adjustment on the guide ways 27, 28, 30, 31, respectively. Motors 38 and 39 carry axially aligned grinding wheels 43, 44, respectively, having opposed, vertically spaced coaxial grinding surfaces 46, 47, respectively. In like manner, motors 40, 42, respectively, carry axially aligned grinding wheels 48, 50 having opposed, vertically spaced coaxial grinding surfaces 51, 52, respectively. Each of the coaxial opposed pairs of grinding surfaces 46, 47 and 51, 52 is adapted to grind the opposite surfaces at one of the ends of connecting rods and other similar articles, as will subsequently be more fully described. The clearance between the opposed pairs of grinding surfaces is adjustable as desired through individual vertical movement of the drive motors 38, 39, 40, 42 by vertical traversing screws 54, 55, 56, 58 driven by the vertical traversing motors 32, 34, 35, 36, respectively.

The upper edge of the table support 12 constitutes a laterally extending guide way 59 on which there is supported a laterally reciprocably movable work table 60. A table drive motor 62, mounted at one end of the table support 12, drives a lateral traversing screw 63 to provide lateral reciprocation of the work table 60. On the top of the work table, there is a mounting surface 64 having a plurality of upstanding transverse abutments 66, spaced along the direction of table reciprocation and adapted to support an equal number of engine connecting rods 67, or the like, as workpieces for finishing by the grinder.

The connecting rods conventionally include central I-sections 68, each having a web 70 which is supported on one of the abutments 66 of the work table 60. A U-clamp 71, provided for each of the connecting rod workpieces, includes legs 72, 74 which respectively engage the work table mounting surface 64 and the connecting rod web 70 on the side opposite that engaging the respective abutment 66, in order to hold the associated connecting rod in position on the work table. A clamping screw 75 extends through each of the clamps 71 and threadably engages the work table 60 to exert a clamping force upon its U-clamp and the associated connecting rod.

Each of the connecting rods further conventionally includes a pin end 76 and a crank end 78 connected together by the I-section 68. As mounted upon the work table 60, the connecting rod crank end 78 includes upwardly and downwardly extending side faces 79, 80, respectively, and the connecting rod pin end 76 includes upwardly and downwardly facing side faces 82, 83, respectively.

As the drawings indicate, the work table 60 is positioned for lateral reciprocation along a path that extends laterally between the dual pairs of grinding wheels 43, 44 and 48, 50. The table 60 supports a plurality of connecting rods 67 with their side faces 79, 80, 82 83, positioned to move into opposed engagement with the grinding surfaces 46, 47, 51, 52, respectively, of the four grinding wheels.

In operation, a plurality of workpieces, such as connecting rods 67, are placed one on each of the abutments 66 of the reciprocable work table 60 and are clamped into position by locating the U-clamps 71 with their legs 74 engaging the I-sections 68 of the connecting rods and tightening the clamp screws 75. The pedestals 19, 20 are properly positioned or adjusted longitudinally and the drive motors 38, 39, 40, 42 are properly positioned or adjusted vertically to provide, upon traversing of the work table 60, for the side faces 79, 80, 82, 83 of the connecting rods to pass between and lightly engage the respective grinding surfaces 46, 47 51, 52 of the grinding wheels. If desired, the stock removal may be completed in a single pass of the traversing table or the operation may occupy several traversing passes, between which the drive motors are vertically repositioned to reduce the space between the paired grinding surfaces and sequentially advance the finishing process to the desired thicknesses and relative dimensions of the connecting rod ends.

It should be apparent that the individual vertical adjustments provided for the four drive motors 38,39,40,42, individually carrying the grinding wheels of the associated pairs, and the longitudinal adjustments provided for the pedestals 19, 20, allow complete flexibility of the grinding machine to accommodate connecting rods and other articles of various lengths and thicknesses, including both parallel and stepped end designs, thus providing a fully adjustable flexible grinding machine arrangement.

Figure 4:
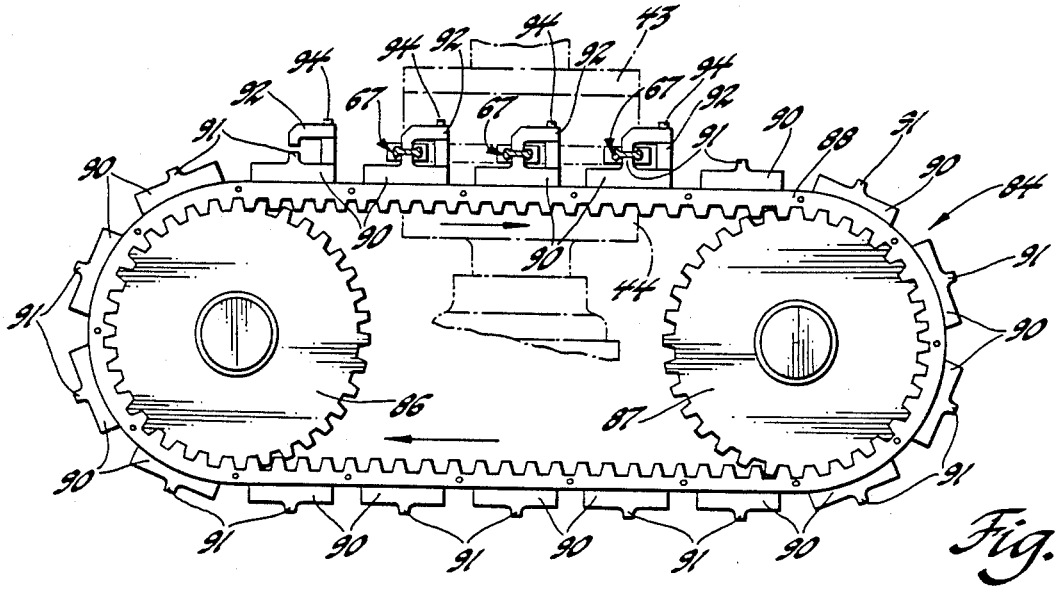
FIG. 4 is a side view of a continuous feed mechanism provided as an alternative to the reciprocating mechanism of FIG. 2.
Figure 5:
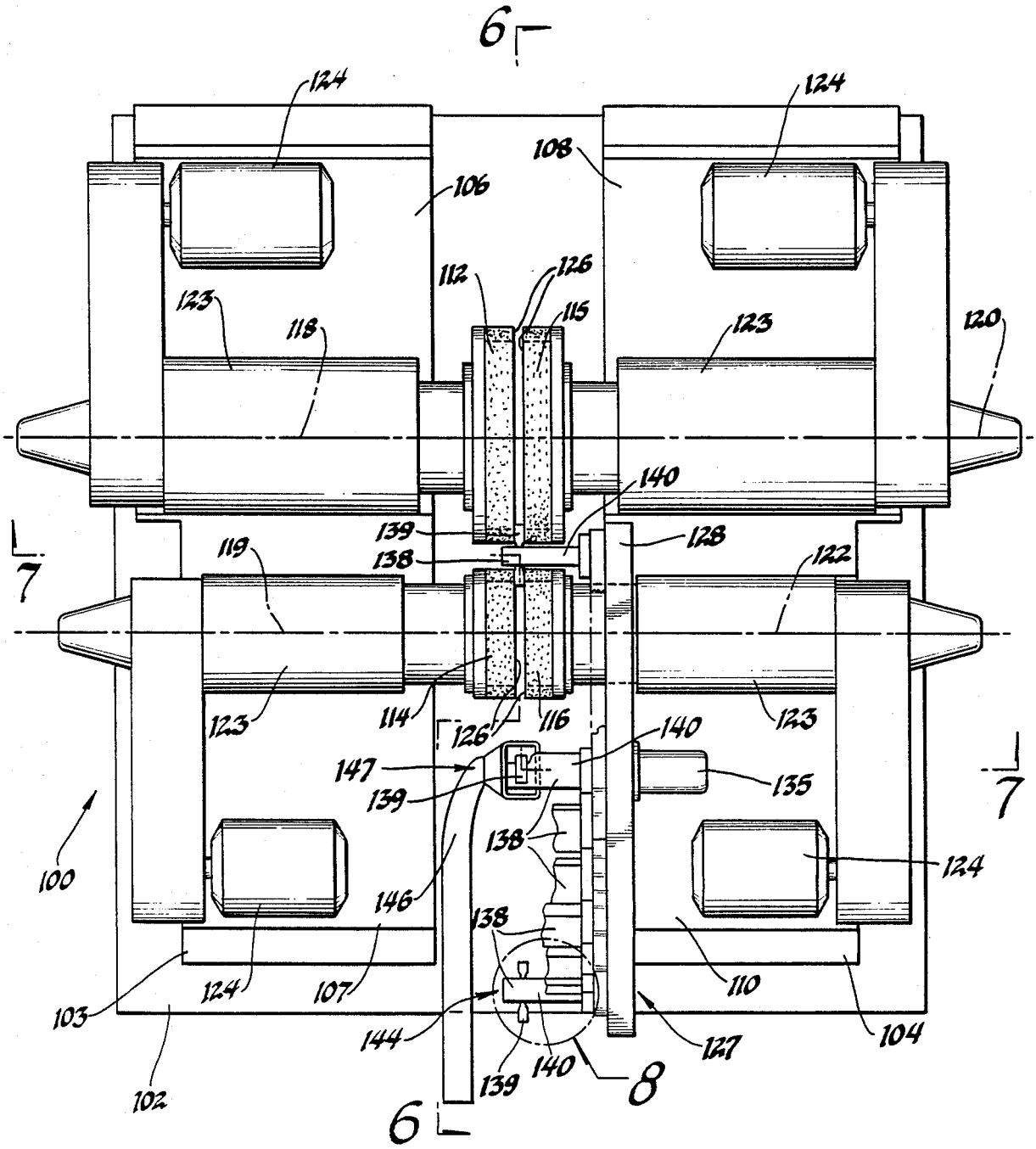
FIG. 5 is a plan view of an alternative embodiment of grinding machine having an annular feed device in accordance with the invention.
Figure 6:
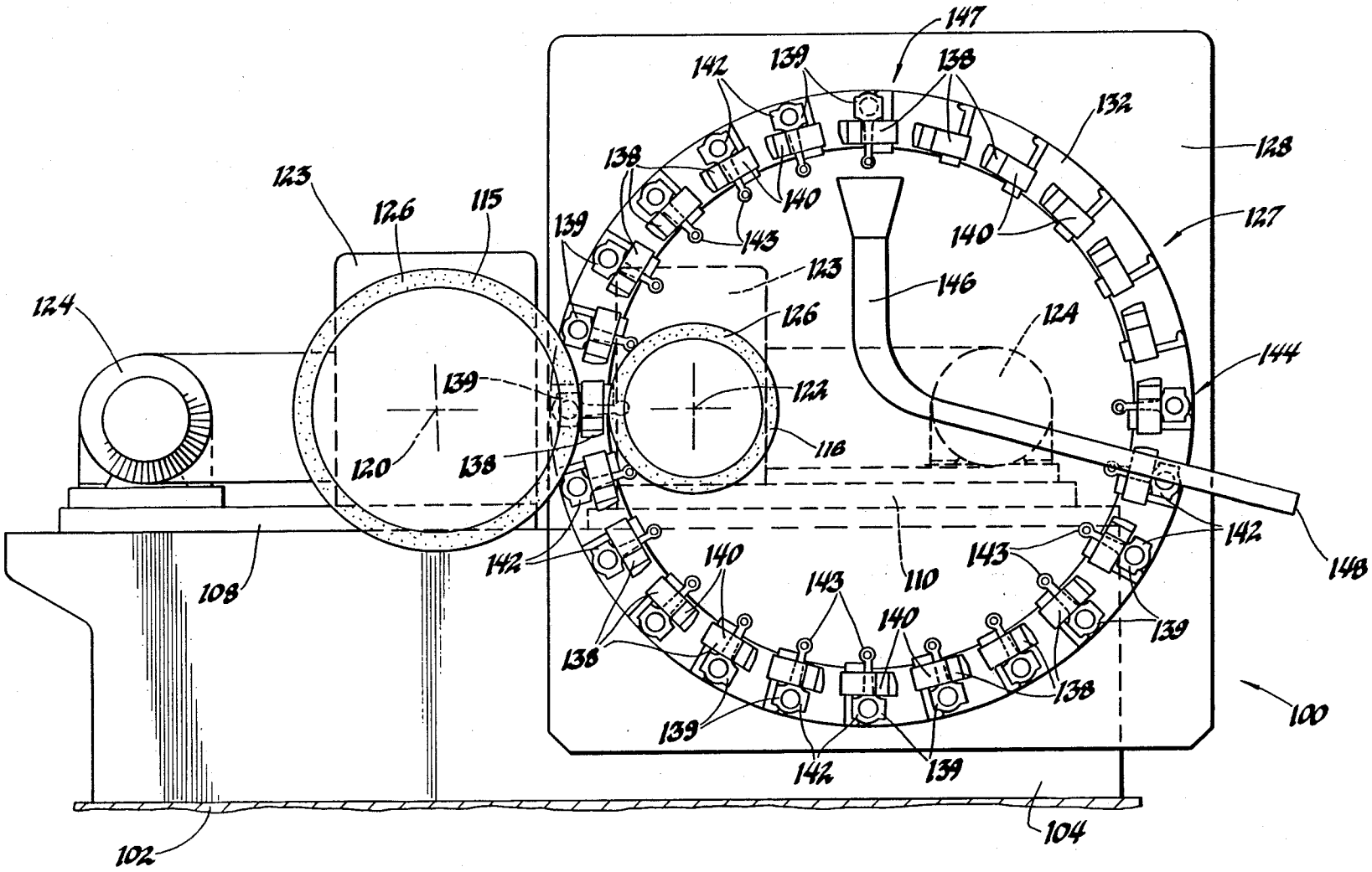
FIG. 6 is a transverse cross-sectional view in the direction of the arrows from the plane of the line 6—6 of FIG. 5.
Figure 7:
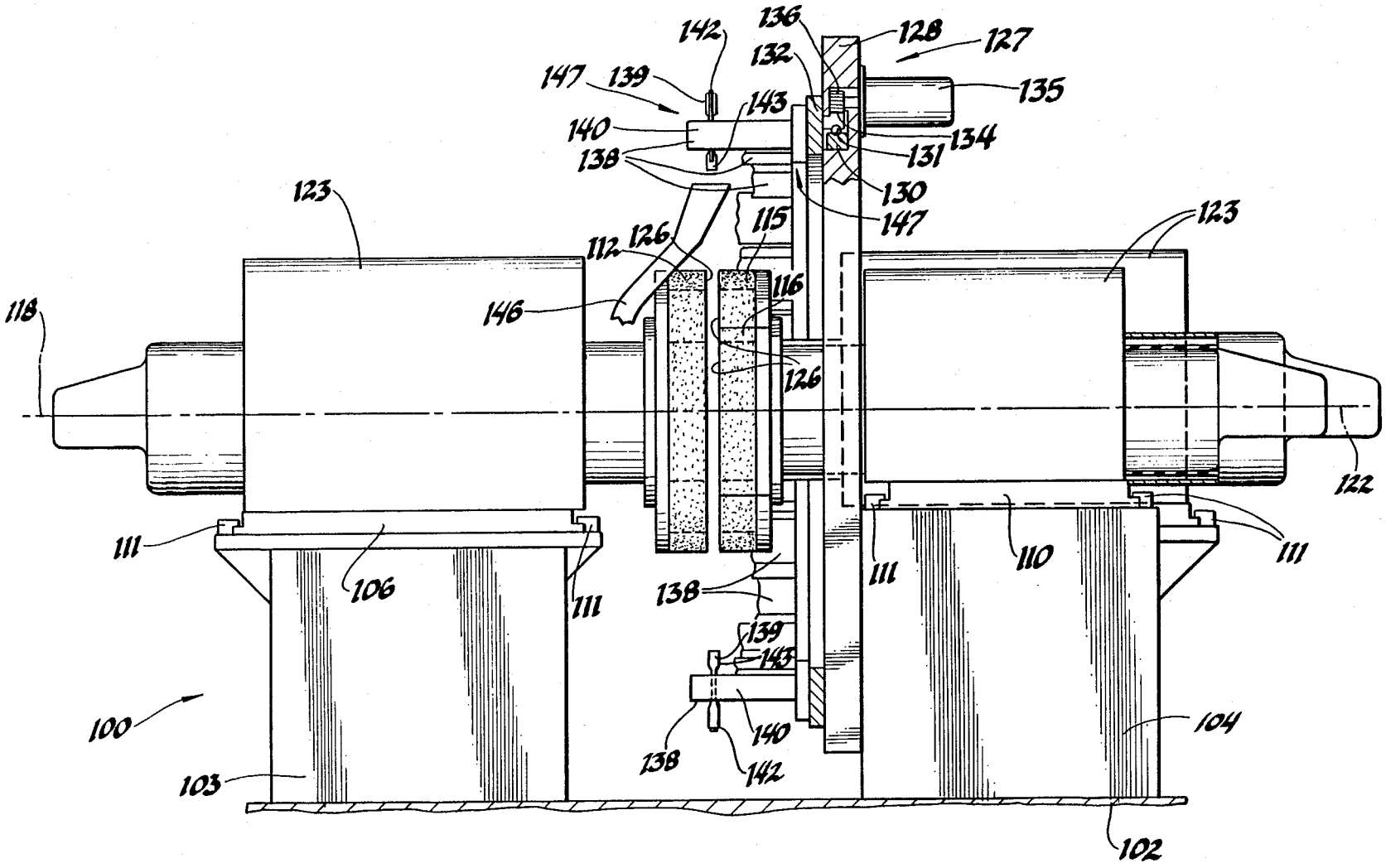
FIG. 7 is a longitudinal cross-sectional view in the direction of the arrows from the plane indicated by the line 7—7 of FIG. 5.

Referring now to FIG. 4, there is shown an alternative embodiment of feed arrangement usable with the grinding machine of FIGS. 1–3 but replacing the traversing table and support of the first described embodiment. In FIG. 4, a feed mechanism generally indicated by numeral 84 includes a pair of laterally aligned rotatable sprockets 86, 87 connected by a conveyer chain or belt 88 and rotatably driven by means not shown. The conveyer belt supports a plurality of support members 90, each having an upstanding abutment 91 adapted to mount a connecting rod 67. Clamp members 92, having clamping screws 94, are mountable upon the support members 90 and engagable with the connecting rods for retaining them in position during the grinding process.

In operation, the upper run of the conveyer belt 88, extending between the sprockets 86, 87 passes between the pairs of grinding wheels, one pair 43, 44 of which are indicated by phantom lines in the drawing. Connecting rods 67 are installed upon the supports 90 as the supports approach the grinding wheels from the sprocket 86. The ends are finish ground in a single pass, after which the finished connecting rods are removed from the conveyer belt as they approach or reach the location of the sprocket 87.

Referring now to FIGS. 5–9, numeral 100 generally indicates another alternative embodiment of grinding machine in accordance with the invention. Machine 100 includes a base 102 having a pair of longitudinally spaced supports 103, 104, carrying four rectangularly spaced tables 106, 107, 108, 110. The tables are arranged in laterally spaced pairs 106, 107 and 108, 110 on supports 103 and 104, respectively, and are each laterally movable in guides 111. The latter may include locking means, not shown, to provide means for individually laterally adjusting the tables on the supports 103, 104.

On each of the tables there is mounted a grinding wheel 112, 114, 115 or 116 rotatable on a generally horizontal axis 118, 119, 120 or 122, respectively. Each of the grinding wheels is carried on it own spindle 123 which is driven by an electric motor 124. The spindles 123 are longitudinally adjustable along the axes of their respective grinding wheels to provide individual longitudinal adjustment of the grinding wheels.

The arrangement of the grinding wheels on the support-carried tables is such as to locate the wheels in laterally spaced pairs of longitudinally spaced wheels, the pairs of wheels being nominally coaxial although adjustable to substantially parallel non-coaxial positions. Grinding surfaces 126 are formed on the ends of the wheels, with the surfaces 126 for each longitudinally spaced pair of wheels facing one another.

The machine 100 is also provided with a connecting rod feeder system generally indicated by numeral 127.

This system includes a support plate or structure 128 mounted on the inside of support 104 and extending upwardly therefrom. Plate 128 fixedly mounts a circular track or race 130 guiding bearing means 131 on which is rotatably mounted an annular fixture wheel 132 having external gear teeth 134. A drive motor 135 mounted on the plate 128 carries a gear 136 engaging the teeth 134 to rotate the fixture wheel during operation.

On the fixture wheel, there are mounted a plurality of annularly spaced longitudinally extending connecting rod holding fixtures 138. The fixtures may be of any suitable construction for accomplishing the desired functions. Their specific features, to be subsequently described, form no part of the present invention. These fixtures 138 are adapted to accept and hold in position near their ends connecting rods 139 or other similar articles to be ground on both faces of opposite ends thereof. The connecting rods are held in their central beam or rod portions 140 intermediate their respective crank ends 142 and pin ends 143. These ends extend radially outwardly and inwardly of the fixtures for grinding of the opposite sides of the ends 142, 143.

Suitable loading means, not shown, may be provided to insert a connecting rod into each fixture as it passes a loading station 144 at the front of the machine 100. An unloading chute 146 is also provided to receive finished parts released from the fixtures at an unloading point 147 near the top of the wheel travel and direct the falling articles to a discharge station 148 on the front of the machine 100.

Figure 8:
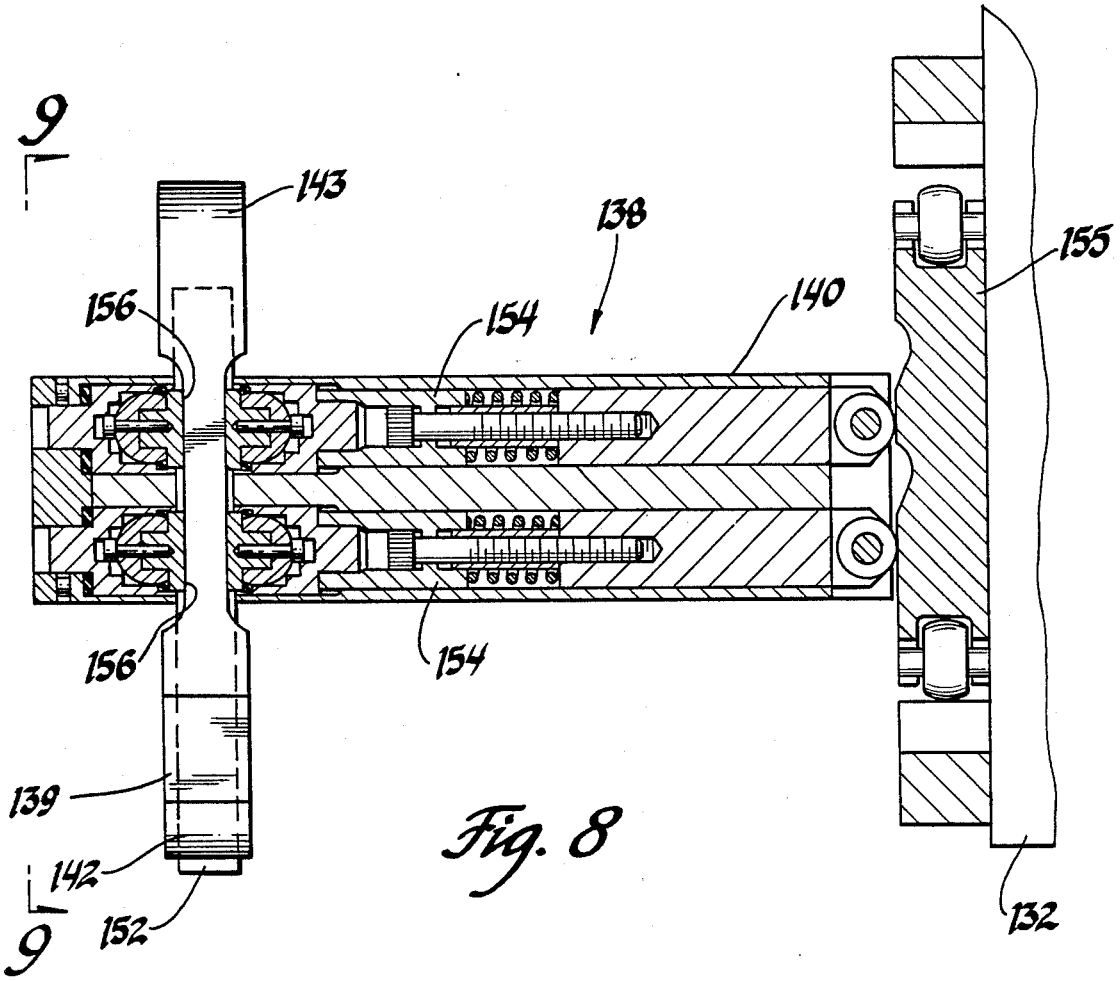
FIG. 8 is an enlarged view of the portion of FIG. 5 indicated by the circle 8 and showing one of the connecting rod holding fixtures with portions broken away to illustrate the interior mechanism.
Figure 9:
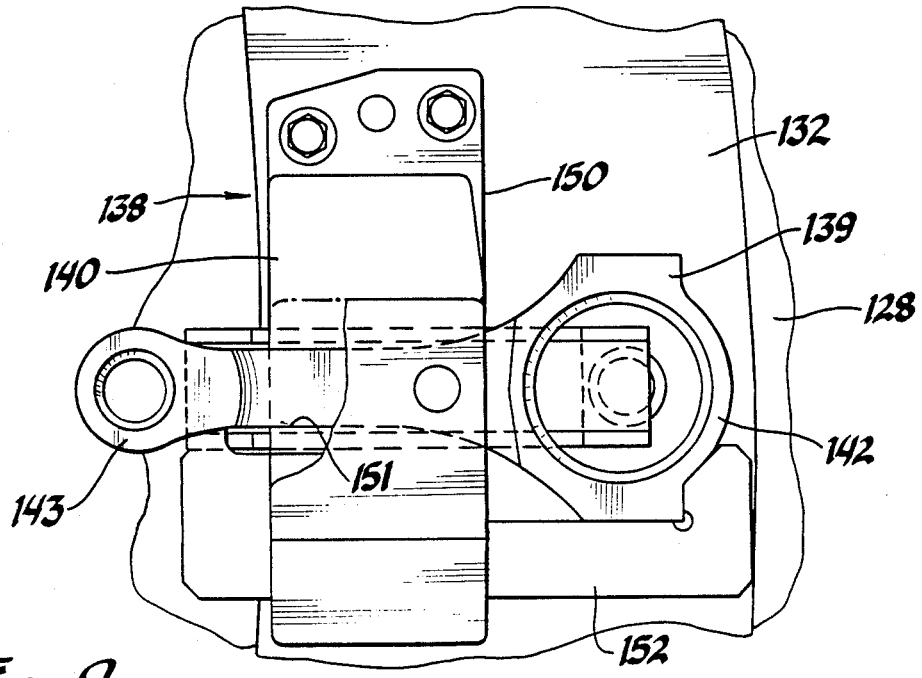
FIG. 9 is an outer end view of the holding fixture from the plane 9—9 of FIG. 8.

As is best shown in FIGS. 8 and 9, the fixtures 138 each include a body 150 extending outwardly from the fixture wheel 132 to a slot 151 near the body outer end to receive a connecting rod 139. A guide bar 152 attached to the body opposite the slot is provided with locating surfaces to properly position each connecting rod as it is placed in the slot. During grinding, spring loaded push rods 154 actuated by a cam engaged slider 155 clamp the connecting rods against seats 156 on the outer side of the slot 151. Subsequently, the slider is cam actuated to release the push rods at the appropriate point to release the connecting rod at the unloading point 147 previously mentioned.

In operation, the wheel 132 rotates, causing the fixtures 138 to carry the connecting rods in an arcuate orbital path from the loading station 144, between the pairs of grinding wheels 112, 115 and 114, 116 and up to the discharge point 147 where the finished parts are released. The wheel pairs 112, 115 and 114, 116 are positioned respectively outside and inside of this orbital path and are located so that the grinding surfaces of each pair engage and grind the opposite sides of one of the ends of each connecting rod as it passes between the pairs of grinding wheels.

Since the grinding wheels are individually longitudinally adjustable through adjustment of their respective spindles 123, the machine may be used to simultaneously grind both sides of both ends of connecting rods having different end thicknesses. Also, other parts, such as offset end wrenches can be ground in this fashion. Further, parts of different lengths can be accommodated by lateral adjustment of the tables 106, 107, 108, 110 which carry the grinding wheels to provide the proper spacing between the wheel pairs.

While the invention has been described by reference to certain preferred embodiments chosen for purposes of illustration, it should be understood that numerous changes could be made in the various details of construction and alternative features described without departing from the spirit or scope of the invention. Accordingly, the subject matter of the claims is not intended to be limited to the disclosed embodiments, but should be given the full scope permitted by their language.

The embodiments of the invention in which an exclusive property or privilege is claimed are defined as follows:

1. An adjustable grinding machine for simultaneously grinding a pair of opposite sides at two opposite ends of a single article, said machine comprising support means for holding a plurality of such articles intermediate their ends with said opposite ends extending beyond opposite sides of said support means, mounting means drivably carrying a first pair of grinding wheels at one of said sides of the support means and a second pair of grinding wheels at the other of said sides of the support means, the grinding wheels of said first pair each having a grinding surface, one engagable with each of said opposite sides of one of the ends of said article and the grinding wheels of said second pair each having a grinding surface, one engagable with each of said opposite sides of the other of the ends of said article, and adjusting means associated with said mounting means for separately adjusting the grinding surfaces of said grinding wheels to simultaneously grind the pairs of opposite sides at the opposite ends of said article and to provide independent location of the relative positions of each of the sides on both ends of the article, wherein said support means comprise a unidirectionally movable continuous path carrier capable of traversing said articles sequentially across said grinding surfaces, and said carrier includes an annular work supporting member located so as to transport said articles in an arc of a circle that, as viewed axially, encompasses the peripheries of the grinding wheels of one of said pairs, approaching said peripheries most closely at a point between them and the peripheries of the other of said pairs.

2. An adjustable grinding machine for simultaneously grinding a pair of opposite sides at two opposite ends of an article, said machine comprising a base, support means carried on the base for holding a plurality of said articles and retaining means for clamping said articles intermediate their ends to said support means with said opposite ends extending beyond opposite sides of said support and clamping means, a first pedestal on the base and drivably carrying a first pair of grinding wheels at one of said sides of the support means, said grinding wheels each having a grinding surface, one engagable with each of said opposite sides of one of the ends of said articles, a second pedestal on the base and drivably carrying a second pair of grinding wheels at the other of said sides of the support means, the grinding wheels of said second pair each having a grinding surface, one engagable with each of said opposite sides of the other of the ends of said articles, and adjusting means on the first and second pedestals for separately adjusting the grinding surfaces of said grinding wheels to simultaneously grind the pairs of opposite sides at the opposite ends of said articles and to provide independent location of the relative positions of each of the sides on both ends of the articles, said support means including a movable work holder capable of traversing said articles sequentially across said grinding surfaces.

3. An adjustable grinding machine as in claim 2 wherein said first and second pedestals are adjustable toward and away from one another and the support means for adjusting the pairs of grinding wheels to allow for grinding similar articles of differing lengths.

4. A combination as in claim 2 wherein said support means include a reciprocable workholder mounted on transverse ways and movable thereon by power actuating means carried by the support means.

5. A combination as in claim 2 wherein said support means comprise a unidirectionally movable continuous path carrier.

6. A combination as in claim 5 wherein said carrier includes a work supporting continuous belt.

7. An adjustable grinding machine for simultaneously grinding a pair of opposite sides at two opposite ends of a single article, said machine comprising support means for holding a plurality of such articles intermediate their ends with said opposite ends extending beyond opposite sides of said support means, first means drivably carrying a first pair of grinding wheels at one of said sides of the support means, said grinding wheels each having a grinding surface, one engagable with each of said opposite sides of one of the ends of said article, second means drivably carrying a second pair of grinding wheels at the other of said sides of the support means, the grinding wheels of said second pair each having a grinding surface, one engagable with each of said opposite sides of the other of the ends of said article, and adjusting means associated with said first and second means for separately adjusting the grinding surfaces of said grinding wheels to simultaneously grind the pairs of opposite sides at the opposite ends of said article and to provide independent location of the relative positions of each of the sides on both ends of the article, wherein said support means comprise a unidirectional continuous path carrier capable of traversing said articles sequentially across said grinding surfaces, and said carrier includes an annular work supporting member located so as to transport said articles in an arc of a circle that, as viewed axially, encompasses the peripheries of the grinding wheels of one of said pairs, approaching said peripheries most closely at a point between them and the peripheries of the other of said pairs.

8. An adjustable grinding machine as in claim 7 wherein said first and second means are adjustable toward and away from one another and the support means to allow for grinding similar articles of differing lengths.

9. An adjustable connecting rod grinding machine for simultaneously grinding a pair of opposite parallel sides at two opposite ends of a connecting rod, said machine comprising a base, support means carried on the base for holding a plurality of said connecting rods and retaining means for clamping said connecting rods intermediate their ends to said support means with said opposite ends extending beyond opposite sides of said support and clamping means, a first pedestal on the base and drivably carrying a first pair of grinding wheels at one of said sides of the support means, said grinding wheels each having a grinding surface, one engagable with each of said opposite parallel sides of one of the ends of said connecting rods, a second pedestal on the base and drivably carrying a second pair of grinding wheels at the other of said sides of the support means, the grinding wheels of said second pair each having a grinding surface, one engagable with each of said opposite parallel sides of the other of the ends of said connecting rods, and adjusting means on the first and second pedestals for separately adjusting the grinding surfaces of said grinding wheels to simultaneously grind the pairs of opposite parallel sides at the opposite ends of said connecting rods and to provide independent location of the relative positions of each of the parallel sides on both ends of the connecting rods, said support means including a movable work holder capable of traversing said connecting rods sequentially across said grinding surfaces.

10. An adjustable connecting rod grinding machine for simultaneously grinding a pair of opposite parallel sides at two opposite ends of a connecting rod, said machine comprising a base, support means carried on the base and rotatably mounting an annular fixture wheel carrying a plurality of annularly spaced holding fixtures for holding a plurality of said connecting rods intermediate their ends with said opposite ends extending beyond opposite sides of said holding fixtures, and means for rotating said fixture wheel to transport said holding fixtures in an annular orbital path, mounting means on the base and drivably carrying a first pair of grinding wheels on the outside of said orbital path and a second pair of grinding wheels on the inside of the orbital path, the grinding wheels of said first pair each having a grinding surface, one engagable with each of said opposite parallel sides of one of the ends of said article and the grinding wheels of said second pair each having a grinding surface, one engagable with each of said opposite sides of the other of the ends of said article, and adjusting means on the mounting means for separately adjusting the grinding surfaces of said grinding wheels to simultaneously grind the pairs of opposite parallel sides at the opposite ends of said connecting rods and to provide independent location of the relative positions of each of the parallel sides on both ends of the connecting rods.

11. An adjustable grinding machine for simultaneously grinding a pair of opposite sides at two opposite ends of an article, said machine comprising a base, support means carried on the base and rotatably mounting an annular fixture wheel carrying a plurality of annularly spaced holding fixtures for holding a plurality of said articles intermediate their ends with said opposite ends extending beyond opposite sides of said holding fixtures, and means for rotating said fixture wheel to transport said holding fixtures in an annular orbital path, mounting means on the base and drivably carrying a first pair of grinding wheels on the outside of said orbital path and a second pair of grinding wheels on the inside of the orbital path, the grinding wheels of said first pair each having a grinding surface, one engagable with each of said opposite sides of one of the ends of said articles and the grinding wheels of said second pair each having a grinding surface, one engagable with each of said opposite sides of the other of the ends of said articles, and adjusting means on the mounting means for separately adjusting the grinding surfaces of said grinding wheels to simultaneously grind the pairs of opposite sides at the opposite ends of said articles and to provide independent location of the relative positions of each of the sides on both ends of the articles.

* * * * *